US006486618B1

(12) United States Patent
Li

(10) Patent No.: US 6,486,618 B1
(45) Date of Patent: Nov. 26, 2002

(54) ADAPTABLE INVERTER

(75) Inventor: Yushan Li, Ossining, NY (US)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 09/965,186

(22) Filed: Sep. 28, 2001

(51) Int. Cl.[7] ..... H05B 37/02

(52) U.S. Cl. ..... 315/291; 315/307; 315/256; 315/250; 315/224

(58) Field of Search ..... 315/291, 307, 315/224, 225, DIG. 5, DIG. 7, 255, 256, 250

(56) References Cited

U.S. PATENT DOCUMENTS 4,259,616 A * 3/1981 Smith ..... 315/185 R
4,293,799 A * 10/1981 Roberts ..... 315/324
4,912,372 A * 3/1990 Mongoven et al. ..... 315/255
6,232,726 B1 * 5/2001 Janczak ..... 315/224
6,304,066 B1 * 10/2001 Wilcox et al. ..... 323/282
6,310,444 B1 * 10/2001 Chang ..... 315/209 R
6,376,999 B1 * 4/2002 Li et al. ..... 315/224

* cited by examiner

*Primary Examiner*—Don Wong
*Assistant Examiner*—Ephrem Alemu

(57) ABSTRACT

A DC-AC inverter that is adaptable for use with different input voltages and for use with different loads. The DC-AC inverter has a voltage-step-up network, with the step-up voltage set by a controller that drives totem-pole configured FET switches at a duty cycle that depends on the desired step-up voltage. The controller beneficially regulates its duty cycle in response to current and/or voltage feedback signals. Also beneficially, the DC-AC inverter includes a configurable inductor and a configurable transformer. Such configurable components enable efficient operation with different loads. Such DC-AC inverters are particularly useful in driving liquid crystal display lamps.

21 Claims, 5 Drawing Sheets

ADAPTABLE INVERTER

BACKGROUND OF THE INVENTION

1. Field of the Invention

The present invention relates to DC-AC inverters. More specifically, it relates to DC-AC inverters that adapt to different input voltages and different loads.

2. Discussion of the Related Art

Producing a color image using a Liquid Crystal Display (LCD) is well known. Such displays are particularly useful for producing images that are updated by frames, such as in LCD desktop and laptop computer. Typically, each image frame is composed of color sub-frames, usually red, green and blue sub-frames.

LCD systems employ a light crystal light panel that is comprised of a large number of individual liquid crystal pixel elements. Those pixel elements are beneficially organized in a matrix comprised of pixel rows and pixel columns. To produce a desired image, the individual pixel elements are modulated in accordance with image information. Typically, the image information is applied to the individual pixel elements by rows, with each pixel row being addressed in each frame period.

Pixel element matrix arrays are preferably "active" in that each pixel element is connected to an active switching element of a matrix of switching elements. One particularly useful active matrix liquid crystal display is produced on a silicon substrate. Thin film transistors (TFTs) are usually used as the active switching elements. Such LCD displays can support a high pixel density because the TFTs and their interconnections can be integrated on the silicon substrate.

FIG. 1 schematically illustrates a single pixel element 10 of a typical LCD. The pixel element 10 is comprised of a twisted nematic liquid crystal layer 12 that is disposed between a transparent common electrode 14 and a transparent pixel electrode 16. Additionally, image signals are applied to the pixel electrode 16 via a control terminal 24.

Still referring to FIG. 1, the liquid crystal layer 12 rotates the polarization of light 30 that passes through it, with the rotation being dependent on the voltage across the liquid crystal layer 12 (the image signal potential). The light 30 is derived from incident non-polarized light 32 from an external light source (which is not shown in FIG. 1). The non-polarized light is polarized by a first polarizer 34 to form the polarized light 30. The light 30 passes through the transparent pixel electrode 16, through the liquid crystal layer 12, and through the transparent common electrode 14. Then, the light 30 is directed onto a second polarizer 36. During the pass through the liquid crystal layer 12, the polarization of the light 30 is rotated in accord with the magnitude of the voltage across the liquid crystal layer 12 (the image signal potential). Only the portion of the light 30 that is parallel with the polarization direction of the second polarizer 36 passes through that polarizer. Since the passed portion depends on the amount of polarization rotation, which in turn depends on the voltage across the liquid crystal layer 12, the voltage on the control terminal 24 controls the intensity of the light that leaves the pixel element.

FIG. 2 schematically illustrates a liquid crystal display comprised of a pixel element matrix. As shown, a plurality of pixel elements 10, each having an associated switching thin film transistor, are arranged in a matrix of rows (horizontal) and columns (vertical). For simplicity, only a small portion of a pixel element matrix array is shown. In practice there are numerous rows, say 1290, and numerous columns, say 1024. Still referring to FIG. 2, the pixel elements of a row are selected by applying a gate (switch) control signal on a gate line, specifically the gate lines 40*a*, 40*b*, and 40*c*. Image signals are then applied to column lines 46*a*, 46*b*, and 46*c*. The various image signal voltages are then applied to associated control terminals 24 of the pixel elements 10. When the gate (switch) control signal is removed, the image signal voltages are then stored on capacitances associated with the TFT.

The foregoing processes are generally well known and are typically performed using digital shift registers, microcontrollers, and voltage sources. Beneficially semiconductor processing technology is used extensively.

The principles of the present invention relate to producing the non-polarized light 32 illustrated in FIG. 1. That non-polarized light 32 is typically produced by a cold cathode fluorescent lamp. This is at least partially because fluorescent lamps are efficient sources of broad-area white light. In battery powered applications, such as portable computers, the efficiency of the fluorescent lamp light source directly impacts battery life, size, and weight.

Fluorescent lamps are typically powered by an inverter. The inverter, in turn, can be powered by a battery or by another power source such as an LCD power supply. In any event, the inverter converts a relatively low DC voltage (say 3–24 volts DC) into a high AC voltage required to drive the fluorescent lamp. Typically over 500 volts are required to operate a cold cathode fluorescent lamp, while a "kick-off" voltage of around 1500 Volts is required to start conduction. Thus, such inverters are DC-to-AC inverters.

FIG. 3 depicts a conventional DC-to-AC inverter 50 in operation. That inverter receives DC power on a line 52. The operating DC-to-AC inverter includes a filter capacitor 54, totem pole arranged FET switches 56 and 58, diodes 57 and 59, an inductor 60, one or more fluorescent lamps (modeled by resistors) 62, each associated with a transformer 64, and a storage capacitor 66. The FET switches 56 and 58 are controlled by a controller 68. In operation, the FET switches 56 and 58 are alternately turned on and off with about equal times (50 % duty cycle) by the controller 68. When the FET 56 is conducting, the FET 58 is OFF. Then, the input on line 52 is switched across the inductor 60 and transformer(s) 64 and the storage capacitance 66. When FET 56 is OFF, the FET 58 is conducting. Additionally, under proper bias conditions, the diodes 57 and 59 conduct. Then, the storage capacitor 66 discharges through the inductor 60 and the transformer(s) 64 to ground.

Essentially, the DC-to-AC inverter 50 forms a simplified circuit shown in FIG. 4. The input voltage supply 80 is formed by the controller 68 selectively switching the FET switches 56 and 58 such that the power input on line 52 is applied to the inductor 60, and then selectively switching that inductor to ground. FIG. 4 also shows an equivalent inductor 84, which is formed by the inductance of the inductor 60 and of the transformer(s) 64. That equivalent inductor 84 beneficially resonates with an equivalent resonant capacitor 80, which is the reflected secondary-side capacitance of the lamp-shield capacitance and the inter-winding parasitic capacitance of the transformer. FIG. 4 also shows an equivalent resistor 90, which represents the transformed resistance of the fluorescent lamp(s) 62.

While DC-to-AC inverters as shown in FIGS. 3 and 4 are generally successful, in some applications they may not be optimal. For example, it is difficult to implement highly efficient DC-to-AC inverters over a wide range of input voltages. That is, the voltage on line 52 becomes critical in the overall design of the DC-to-AC inverters, and thus to the LCD display. In practice DC-to-AC inverters must be tailored to a particular LCD display's backlight inverter input voltage.

Even if a DC-to-AC inverter's input voltage range is acceptable, a DC-to-AC inverter usually only works well when designed for a particular load. That is, the equivalent lamp resistance 90 (see FIG. 4) and capacitance 80 must be taken into consideration when designing a particular DC-to-AC inverter. Thus, DC-to-AC inverters are usually designed to operate only with a narrow range of fluorescent lamps. Changes in lamp styles, sizes, or manufacturers can create problems.

The foregoing problems with DC-to-AC inverters mean that prior art LCD display DC-to-AC inverters either were designed for a particular application, or that inefficient operation had to be accepted. Since neither choice is desirable, a new DC-to-AC inverter that is adaptable to different input voltages and loads (fluorescent lamps) would be beneficial.

SUMMARY OF THE INVENTION

Accordingly, the principles of the present invention provide for systems, such as LCD displays, that include DC-to-AC inverters that are adaptable for use with different input voltages and different loads. In LCD displays, this enables different lamps to be operated under different input voltage conditions without requiring a new DC-to-AC inverter design. Such is particularly beneficial in reducing costs since a given DC-to-AC inverter design will work in many different applications, thus enabling economies of scale.

A DC-AC inverter that is according to the principles of the present invention includes a voltage-step-up network, with the step-up voltage set by a controller that drives totem-pole configured FET switches according to the desired step-up voltage. The controller beneficially regulates its duty cycle in response to current and/or voltage feedback signals. Also beneficially, the DC-AC inverter includes a configurable inductor and a configurable transformer. Such configurable components enable efficient operation with different loads. Such DC-AC inverters are particularly useful in driving liquid crystal display lamps. When the lamps are behind the LCD pixel array, the DC-to-AC inverter is often referred to as a backlight inverter.

Additional features and advantages of the invention will be set forth in the description that follows, and in part will be apparent from the description, or may be learned by practice of the invention. The objectives and other advantages of the invention will be realized and attained by the structure particularly pointed out in the written description and claims hereof as well as the appended drawings.

It is to be understood that both the foregoing general description and the following detailed description are exemplary and explanatory and are intended to provide further explanation of the invention as claimed.

BRIEF DESCRIPTION OF THE DRAWING

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE ILLUSTRATED EMBODIMENT

Reference will now be made in detail to an illustrated embodiment of the present invention, the example of which is shown in the accompanying drawings. That embodiment represents an adaptable DC-AC inverter that is well suited for use battery operated LCD displays and for driving fluorescent lamps. However, battery operation is not required, and adaptable DC-AC inverters will find wide use in applications powered by other supplies.

Figure 1:
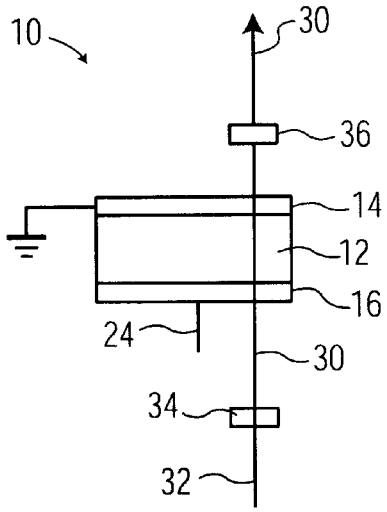
FIG. 1 PRIOR ART
FIG. 1 schematically illustrates a prior art liquid crystal pixel element.
Figure 2:
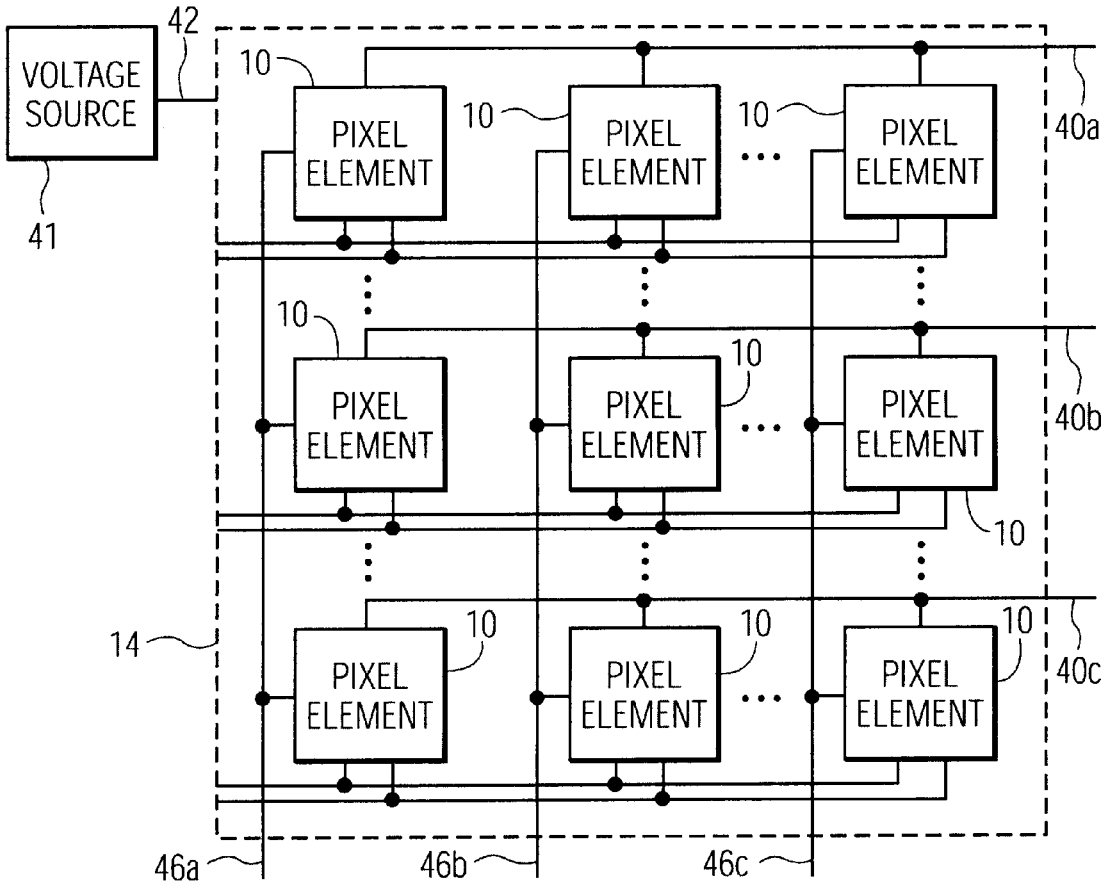
FIG. 2 schematically illustrates a prior art LCD display comprised of a plurality of pixel elements arranged in a matrix.
Figure 3:
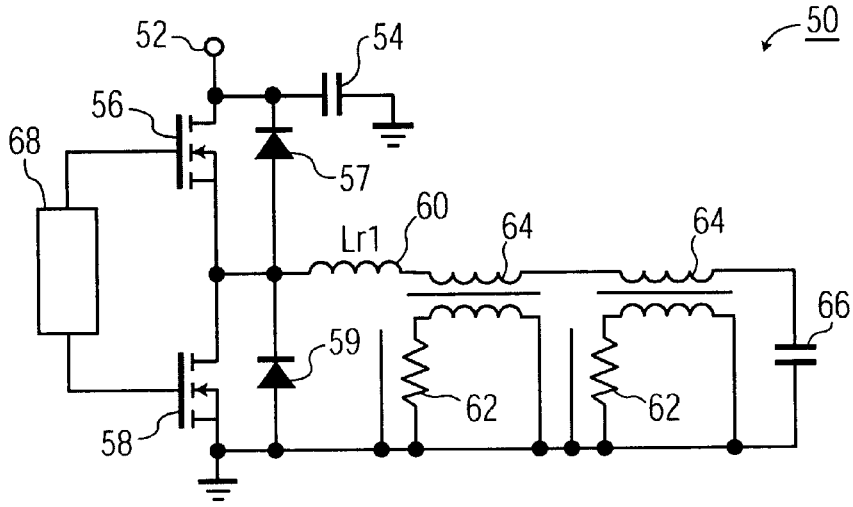
FIG. 3 PRIOR ART
FIG. 3 is a schematic illustration of a conventional DC-AC inverter.
Figure 5:
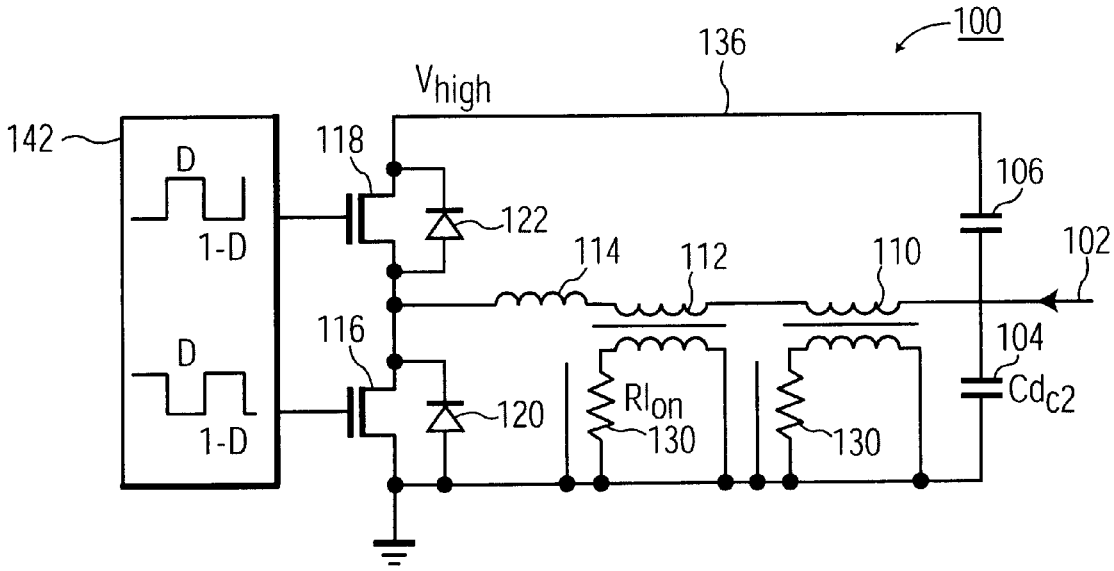
FIG. 5 is a simplified schematic illustration of a DC-AC inverter according to the principles of the present invention.

As previously described, each pixel element 10 (see FIG. 1) of an LCD display (see FIG. 2) modulates light 32 produced by a cold cathode fluorescent lamp (represented by a resistance 62 in FIG. 3). Furthermore, that fluorescent lamp is driven by a "backlight" DC-AC inverter. FIG. 5 is a simplified schematic illustration of a DC-AC inverter 100 that is in accord with the principles of the present invention. As shown, that DC-AC inverter receives a DC input voltage on a line 102. The DC-AC inverter 100 includes a filter capacitor 104 and a high voltage storage capacitor 106, both of which connect to the line 102. Alternatively, the high voltage storage capacitor 106 could be connected to ground. Also connected to the line 102 is a series combination of a first transformer 110, a second transformer 112, and an inductor 114. Beneficially, the first and second transformers 110 and 112, and the inductor 114 are selectively configured elements as described in more detail subsequently. Totem pole arranged FET switches 116 and 118, which beneficially include integral diodes 120 and 122, are connected to the inductor 114. A fluorescent lamp (modeled by resistors) 130 connects to the secondary of each transformer 110 and 112.

Still referring to FIG. 5, the high voltage storage capacitor 106 connects to a high voltage line 136. Also connected to the line 136 are the drain of the FET 118 and the cathode of the diode 122. The FETs 118 and 116 are controlled by a controller 142. The controller drives the FETs according to a duty cycle DC and a predetermined switching period T. The FET 118 is turned on for the time T, while the FET 116 is turned on for a time DC-T. That is, the FETs are driven such that each is on for a portion of each duty cycle, when FET 116 is conducting, FET 118 is OFF and visa versa. Furthermore, the FETs are not necessarily driven with 50 % duty cycles.

As the controller 142 switches the FETs 118 and 116, currents flow through the inductor such that the average DC voltage across the inductor is zero. Thus, the relationship between the input voltage ($V_{in}$) on line 102 and the high voltage ($V_{high}$) on line 136 is:

$$V_{high}D=V_{in},$$

or $$V_{high}=V_{in}/D$$

In operation, the high voltage capacitor 106 is charged to $V_{high}$ during the upper switch diode 122 conduction time. Furthermore, the high voltage capacitor 106 discharges to drive the transformers when the FET 118 turns on. Therefore, the controller 142 can drive a fluorescent lamp under different input voltages by controlling the duty cycle DC.

Figure 4:
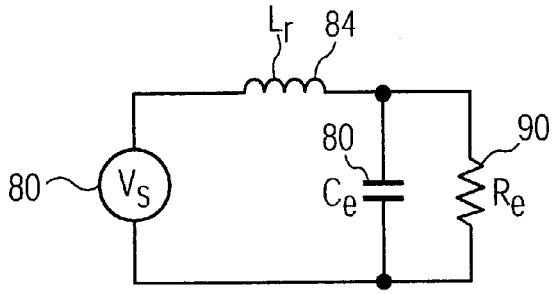
FIG. 4 is a simplified schematic depiction of the conventional DC-AC inverter shown in FIG. 3.

By operating at a higher voltage, the efficiency of the DC-AC inverter 100 can be improved. This is because the majority of the power lost in a DC-AC inverter is a result of current (I) that passes through the total equivalent series resistance (ESR) of the inductor 114 (in FIG. 4), transformers 1 10 and 1 12, capacitors 104 and 106, and switches 116 and 118. The power loss (PIOs) is equal to:

$$P_{loss}=I^2ESR$$

By delivering the same power to the fluorescent lamps using less current in the inductor, such as by switching a higher voltage, the efficiency of the DC-AC inverter 100 is improved.

Figure 6:
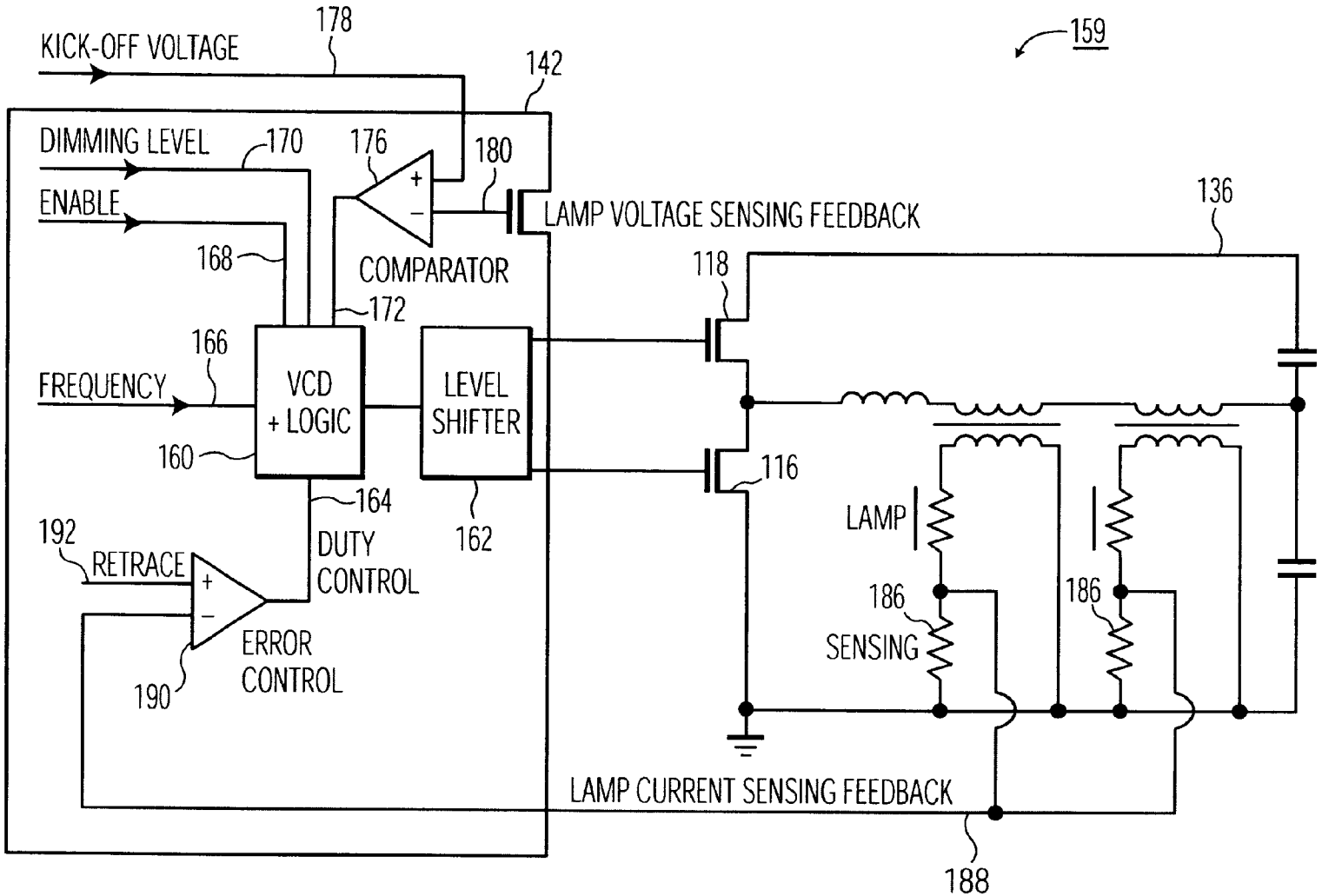
FIG. 6 schematically illustrates the DC-AC inverter shown in FIG. 5 in more detail.

FIG. 6 schematically illustrates the DC-AC inverter shown in FIG. 5 in more detail. Specifically, FIG. 6 shows a universal backlight inverter 159 with pulse width modulation control (duty cycle control). The backlight inverter 159 includes a configurable inductance and a configurable transformer. In addition, to achieve a more universal backlight inverter, as shown in FIG. 6, the backlight inverter 159 includes a dimming level, an operating frequency value, an enable signal, and a kick-off voltage input. Also included is a logic circuit and voltage controlled oscillator VCO 160. The logic circuit and VCO 160 controls a level shifter 162 having complementary outputs. Those complementary outputs drive the FETs 118 and 116. Inputs to the logic circuit and VCO 160 includes a duty control cycle on a line 164, the operating frequency input value on a line 166, the enable signal on a line 168, the dimming control signal on a line 170, and a comparator output signal on a line 172.

The enable signal on the line 168 enables the controller, and thus enables the fluorescent lamps to light. If the enable signal is not on, the fluorescent lamps are OFF. The frequency input on the line 166 controls the frequency of operation, and thus the cycle time DC. A reference dimming level, operating frequency input value, and required kick-off voltage are set before the enable signal turns from OFF to ON. As explained subsequently, when the enable signal turns ON, the controller adjusts its operating frequency to obtain the required "kick-off" voltage.

To assist obtaining the "kick-off" voltage the controller 142 includes a kick-off comparator 176. That kick-off comparator 176 receives a predetermined kick-off voltage signal on a line 178 and a lamp voltage feedback signal on a line 180. The line 180 is beneficially connected to a transformer's secondary. The logic circuit and VCO 164 drives the level shifter 162 such that the lamp voltage builds up to a level that will kick-off (initiate) the fluorescent lamps. During kick-off, the controller sweeps the switching frequency from high to low such that the lamp voltage reaches a predetermined kick-off voltage level. After that, the switching frequency is set according to the operating frequency input value.

In practice the fluorescent lamps should be driven with a predetermined current. To assist this, the fluorescent lamp currents are passed through sensing resistors 186. The voltage drops across those resistors are applied on a lamp current sense line 188 to an error amplifier 190, which is part of the controller 142. Also applied to the error amplifier 190 is a reference signal on a line 192. That reference signal determines the lamp current during full light output conditions. The output of the error amplifier is applied on the line 164. In operation, the voltage on the lamp current sense line 188 is compared to the reference signal. If the voltage on the lamp current sense line 188 is less than the reference signal the duty cycle of the FETs 118 and 116 is changed to increase the lamp current. If the voltage on the lamp current sense line 188 is greater than the reference signal the duty cycle of the FETs 118 and 116 is changed to decrease the lamp current.

Finally, the dimming level 170 is used by the logic circuit and VCO 160 to adjust the lamp intensity. If the lamp intensity is to be reduced, the logic circuit and VCO changes the duty cycle of the FETs 118 and 116 to decrease the lamp intensity. If the lamp intensity is to be increased, the logic circuit and VCO 160 changes the duty cycle of the FETs 118 and 116 to increase the lamp intensity. It is also well known that dimming can be achieved using a pulse width modulation method.

The various inputs to the controller 142, such as the dimming level, the enable signal, and the frequency input, are beneficially controlled by a microcontroller or other programmable device.

Figure 7:
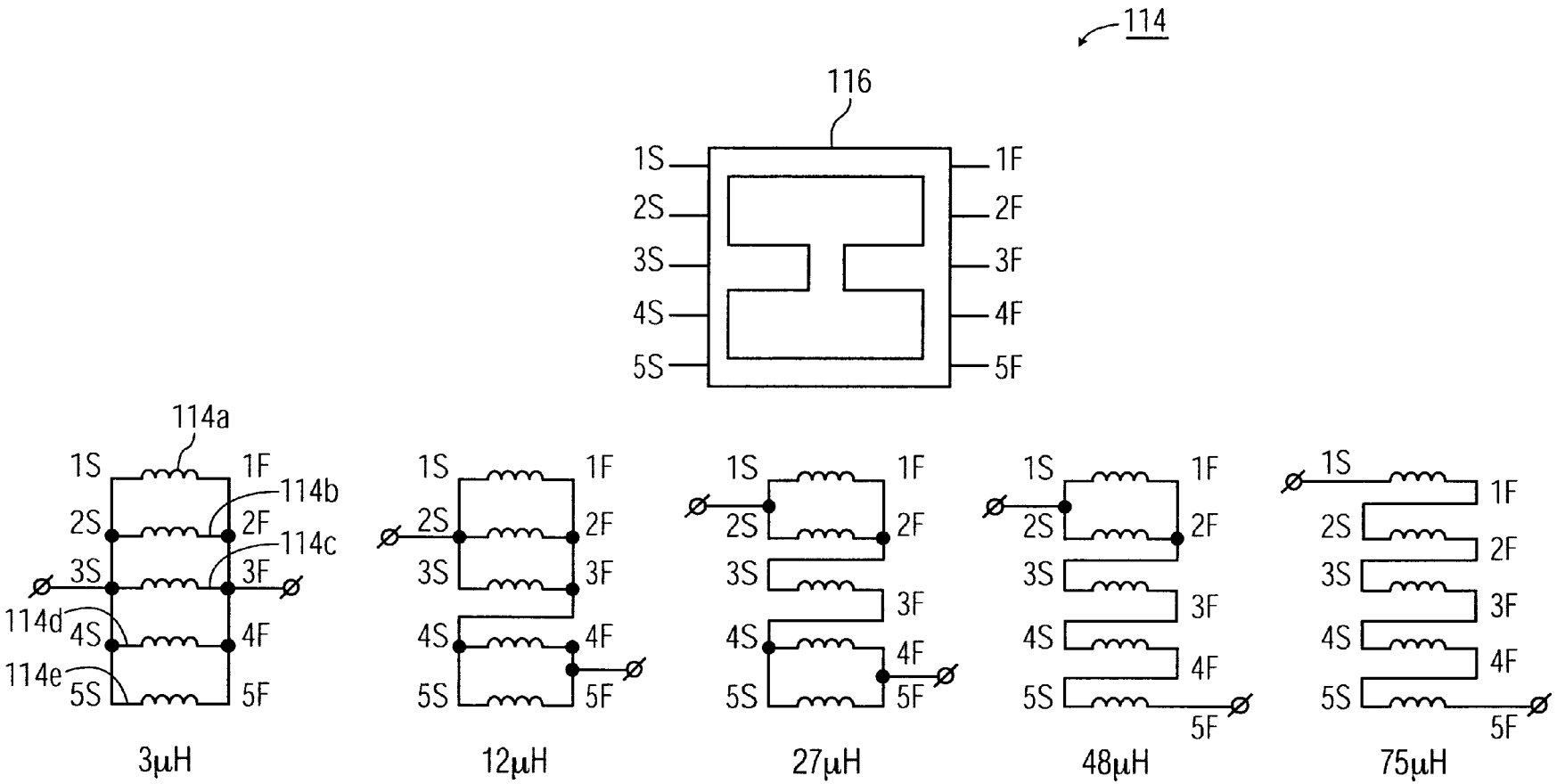
FIG. 7 illustrates possible inductor connections with the DC-AC inverter illustrated in FIGS. 5 and 6.

While the foregoing general description has provided for a DC-AC inverter 100 that is adaptable for use with different input voltages, various improvements can be made to that inverter. For example, FIG. 7 illustrates a possible configuration for the inductor 114. As shown, the inductor 114 is beneficially comprised of a plurality of discrete inductors 114*a*-114*e* . Those inductors are wound on a common core 116. The inductors 114*a*-114*e* can be connected together in numerous ways, as illustrated in FIG. 7. For example, if each discrete inductor 114 is 15 $\mu$H, an inductance of 3 to 75 $\mu$H can be produced simply by interconnecting the inductors 114*a*-114*e* in different ways. Other values of discrete inductances can be used.

Figure 8:
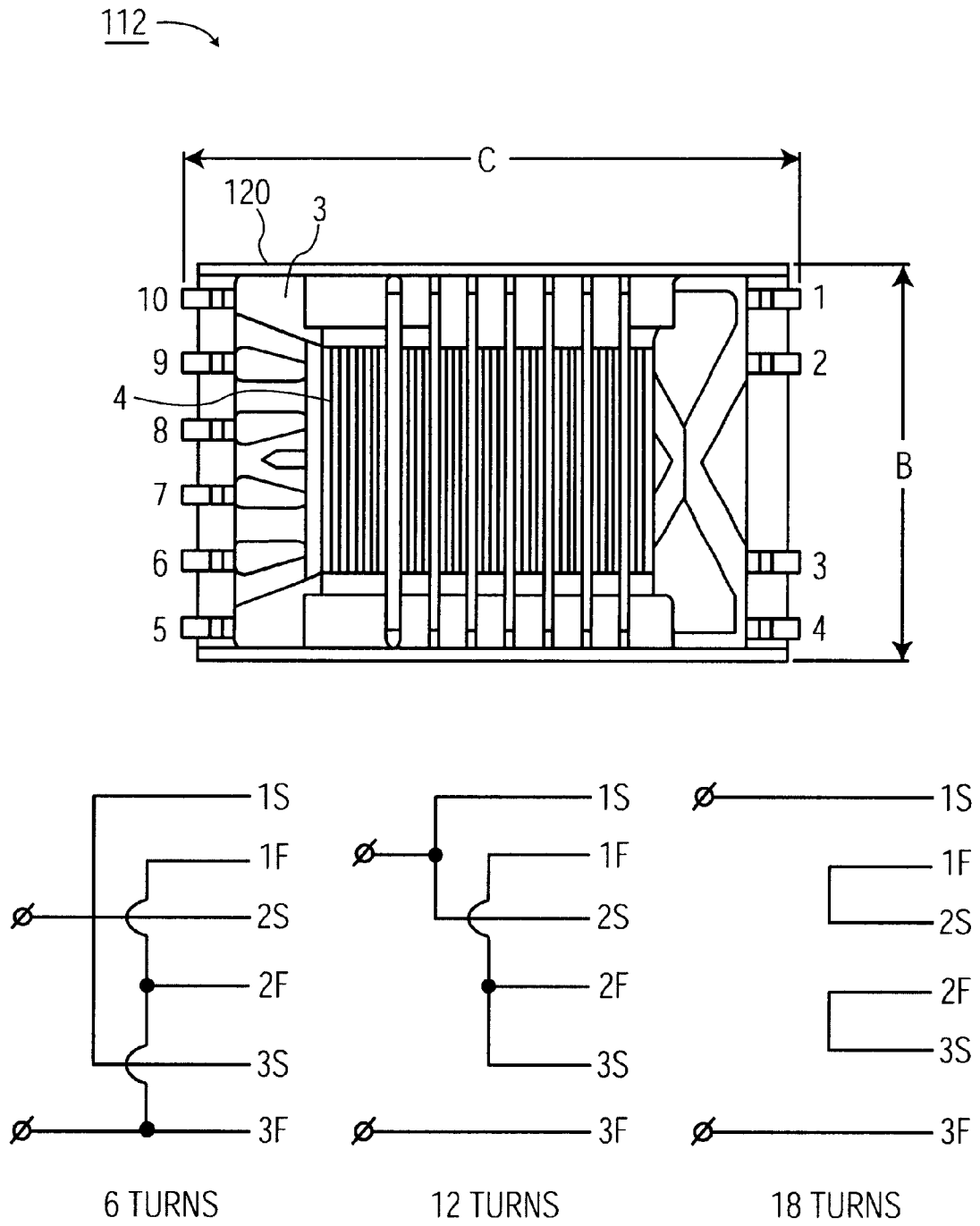
FIG. 8 illustrates possible transformer connections with the DC-AC inverter illustrated in FIGS. 5 and 6.

In addition to a configurable inductance, the DC-AC inverter 100 beneficially includes a configurable transformer 112 as shown in FIG. 8. As shown, the transformer 112 is beneficially comprised of a plurality of primary (and/or secondary) windings. FIG. 8 shows three different windings, a first primary winding set 1s-1f, a second primary winding set 2s-2f, and a third primary winding set 3s-3f. Those primary windings are wound on a common core 120. The various primary winding sets can be connected together in numerous ways. For example, as all winding sets can be paralleled or connected in series. Different combinations are also possible. Furthermore, multiple secondary windings can also be included.

The combination of a configurable inductor 116 and transformer 114 enables the DC-AC inverter 100 to match different loads, such as different fluorescent lamps 130. This enables a single DC-AC inverter 100 design to adapt to different applications.

It will be apparent to those skilled in the art that various modifications and variation can be made in the present invention without departing from the spirit or scope of the invention. Thus, it is intended that the present invention covers the modifications and variations of this invention provided they come within the scope of the appended claims and their equivalents.

What is claimed is:

1. A DC-AC inverter, comprising:

an input line for receiving a DC input voltage;

a first semiconductor switch connected to a high voltage line, said first semiconductor switch including a first control terminal;

a second semiconductor switch connected to said first semiconductor switch at a first node, and to a reference ground, said second semiconductor switch including a second control terminal;

a first diode connected between said first node and said high voltage line;

a second diode connected between said first node and said reference ground;

a storage capacitor connected to said high voltage line;

a series combination of an inductor and a primary of at least one transformer, wherein said series combination is connected between said input line and said first node;

a load connected across a secondary of said at least one transformer; and a controller electrically connected to said first control terminal and to said second control terminal.

2. A DC-AC inverter according to claim 1, wherein said first semiconductor switch is a field effect transistor.

3. A DC-AC inverter according to claim 1, wherein said input line receives a DC input voltage from a battery.

4. A DC-AC inverter according to claim 1, wherein said controller is for setting the voltage on said high voltage line by controlling the ON time of said first semiconductor switch and the ON time of said second semiconductor switch.

5. A DC-AC inverter according to claim 1, wherein said controller is for controlling the ON time of said first semiconductor switch and the ON time of said second semiconductor switch such that the voltage $V_{high}$ on said high voltage line is set by:

$$V_{high}=V_{in}/D$$

wherein $V_{in}$ is the voltage on said input line; and wherein D is a time period of a duty cycle DC that the first semiconductor switch is ON.

6. A DC-AC inverter according to claim 5, wherein said controller second semiconductor switch is ON for a time period of said duty cycle DC that said first semiconductor switch is OFF.

7. A DC-AC inverter according to claim 5, wherein said controller is for receiving a lamp current sensing signal, and wherein said controller is further for setting $V_{high}$ in response to said lamp current sensing signal.

8. A DC-AC inverter according to claim 7, wherein said lamp current sensing signal is derived from a resistance in series with said load.

9. A DC-AC inverter according to claim 5, wherein said controller is for receiving a lamp voltage signal and a kick-off voltage signal, and wherein said controller is further for setting $V_{high}$ in response to said lamp voltage signal and to said kick-off voltage signal.

10. A DC-AC inverter according to claim 5, wherein said controller is for receiving a dimming signal, and wherein said controller is further for setting $V_{high}$ in response to said dimming signal.

11. A DC-AC inverter according to claim 1, wherein said load includes a fluorescent lamp.

12. A DC-AC inverter according to claim 1, wherein said inductor includes a plurality of discrete inductors wound on a common core, and wherein plurality of discrete inductors can be configured to produce a plurality of inductances.

13. A DC-AC inverter according to claim 1, wherein said at least one transformer is comprised of a plurality of discrete windings wound on a common core, and wherein plurality of discrete windings can be configured to produce a plurality of turns ratios.

14. A liquid crystal display, comprising:

a liquid crystal display panel having a plurality of pixel elements arranged in a matrix;

at least one lamp for producing light that is directed onto said liquid crystal display panel; and a DC-AC inverter for driving said at least one lamp, said DC-AC inverter including:

an input line for receiving a DC input voltage;

a first semiconductor switch connected to a high voltage line, said first semiconductor witch including a first control terminal;

a second semiconductor switch connected to said first semiconductor switch at a node and to a reference ground, said second semiconductor switch including a second control terminal;

a first diode connected between said first node and said high voltage line;

a second diode connected between said node and said reference ground;

a storage capacitor connected to said high voltage line;

a series combination of an inductor and a primary of at least one transformer, wherein said series combination is connected between said input line and said node; and a controller electrically connected to said first control terminal and to said second control terminal;

wherein said lamp is connected to a secondary of said at least one transformer.

15. A liquid crystal display according to claim 14, wherein said first semiconductor switch is a field effect transistor.

16. A liquid crystal display according to claim 14, wherein said controller is for setting the voltage on said high voltage line by controlling the ON time of said first semiconductor switch and the ON time of said second semiconductor switch such that the voltage $V_{high}$ on said high voltage line is:

$$V_{high}=V_{in}/D$$

wherein $V_{in}$ is an input voltage; and wherein D is a time period of a duty cycle DC that the first semiconductor switch is ON.

17. A liquid crystal display according to claim 16, wherein said second semiconductor switch is ON for a time period of said duty cycle DC that said first semiconductor switch is OFF.

18. A liquid crystal display according to claim 7, wherein said controller is for receiving a lamp current sensing signal, and a dimming signal, and wherein said controller is further for setting $V_{high}$ in response to said lamp current sensing signal and in response to said dimming signal.

19. A liquid crystal display according to claim 14, wherein said inductor includes a plurality of discrete inductors wound on a common core, and wherein plurality of discrete inductors can be configured to produce a plurality of inductances.

20. A liquid crystal display according to claim 14, wherein said at least one transformer is comprised of a plurality of discrete windings wound on a common core, and wherein plurality of discrete windings can be configured to produce a plurality of turns ratios.

21. A liquid crystal display according to claim 14, wherein said first diode is integrally packaged with said first semiconductor switch.

* * * * *